US010099469B2

(12) United States Patent
Codara

(10) Patent No.: US 10,099,469 B2
(45) Date of Patent: Oct. 16, 2018

(54) METHOD FOR PRINTING ELECTRICAL-COMPONENT IDENTIFICATION LABELS OBTAINED FROM WHOLE BASE SUPPORTS

(71) Applicant: Morsettitalia S.p.A., Milan (IT)

(72) Inventor: Filippo Codara, Milan (IT)

(73) Assignee: MORSETTITALIA S.P.A., Milan (IT)

( * ) Notice: Subject to any disclaimer, the term of this patent is extended or adjusted under 35 U.S.C. 154(b) by 0 days.

(21) Appl. No.: 15/358,344

(22) Filed: Nov. 22, 2016

(65) Prior Publication Data

US 2017/0165954 A1 Jun. 15, 2017

(30) Foreign Application Priority Data

Nov. 23, 2015 (IT) ..... 10201500075469

(51) Int. Cl.

| | |
|---|---|
| ***B41F 3/51*** | (2006.01) |
| ***B41F 17/00*** | (2006.01) |
| ***G09F 3/00*** | (2006.01) |
| *G09F 3/02* | (2006.01) |

(52) U.S. Cl.

CPC ..... *B41F 3/51* (2013.01); *B41F 17/00* (2013.01); *G09F 3/0286* (2013.01); *G09F 3/0295* (2013.01); *G09F 2003/0201* (2013.01)

(58) Field of Classification Search

CPC ..... B41F 3/851; B41F 17/00; G09F 3/0286; G09F 3/0295; G09F 2003/0201

See application file for complete search history.

(56) References Cited

U.S. PATENT DOCUMENTS

2010/0328714 A1* 12/2010 Allen ..... G06F 3/04847 358/1.15

2014/0068983 A1 3/2014 Adams et al.

FOREIGN PATENT DOCUMENTS

| | | | |
|---|---|---|---|
| EP | 1058201 | A1 | 12/2000 |
| WO | 2011/146603 | A2 | 11/2011 |
| WO | 2015/151042 | A2 | 10/2015 |
| ZA | 2002/7284 | | 7/2003 |

OTHER PUBLICATIONS

Pantoja Conde, A.; Search report & written opinion from corresponding European Application No. 16199914.9; search completed Feb. 10, 2017.

Pantoja Conde, A.; Search report & written opinion issued in connection with priority Italian Application No. 102015000075469 (IT UB20155829); search completed Jul. 6, 2016.

* cited by examiner

*Primary Examiner* — Leslie J Evanisko
*Assistant Examiner* — Marissa Ferguson Samreth

(57) ABSTRACT

A method for producing labels from a base support according to predefined card standard ISO CR80 ISO 7810 is disclosed. In the method, a base support is provided according to the predefined standard, the base support comprising at least one non-removable region and at least one removable region having dimensions substantially corresponding to the size of the label to be printed. The base support is inserted into a printer for performing printing on base supports according to the standard. Alphanumeric and/or graphical labelling information is selectively printed on at least one removable region of the base support. The printed base support from is then extracted from the printer. Accordingly, selective printing of identification labels for electrical components by means of thermal printers is achieve without the need for special base plates.

8 Claims, 2 Drawing Sheets

Fig. 1
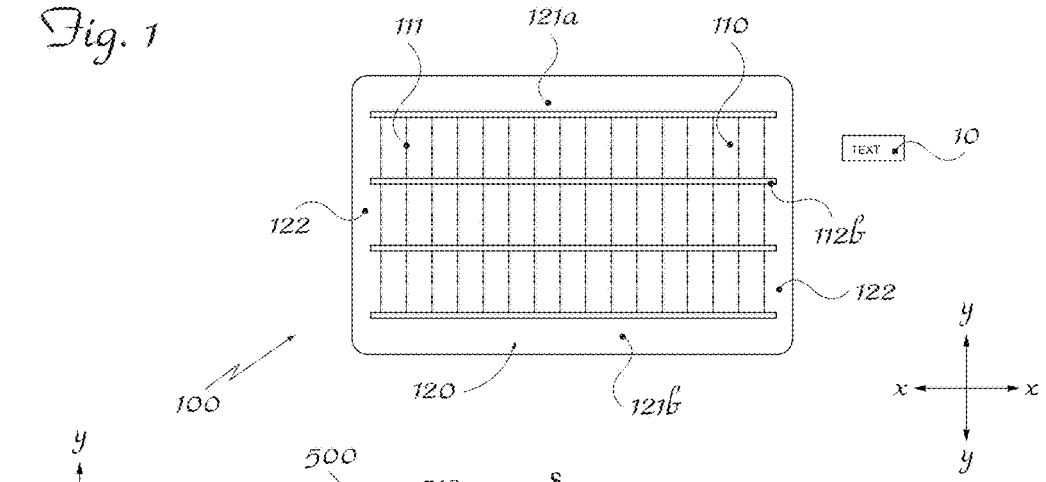
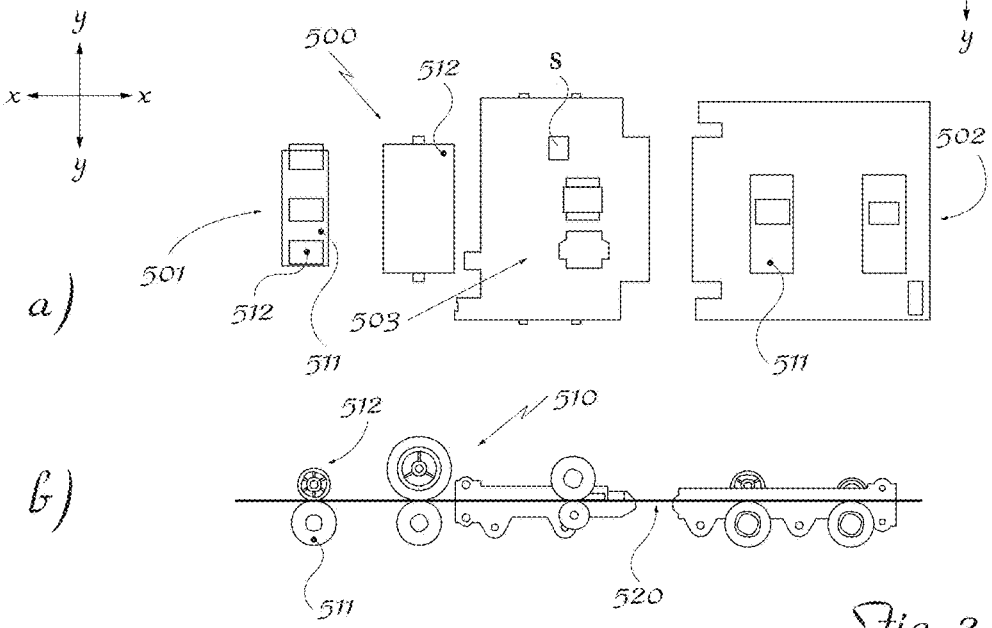
Fig. 2
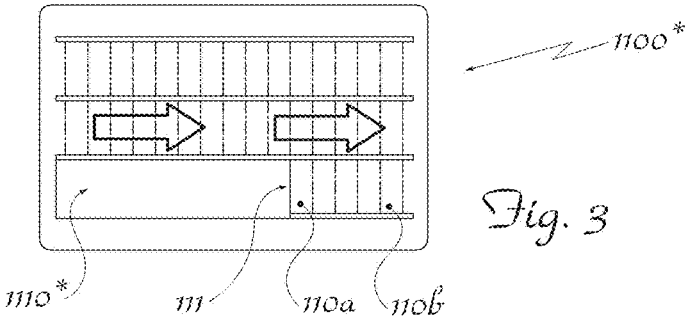
Fig. 3

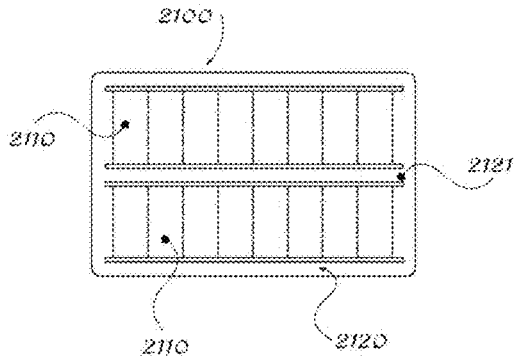
Fig. 5
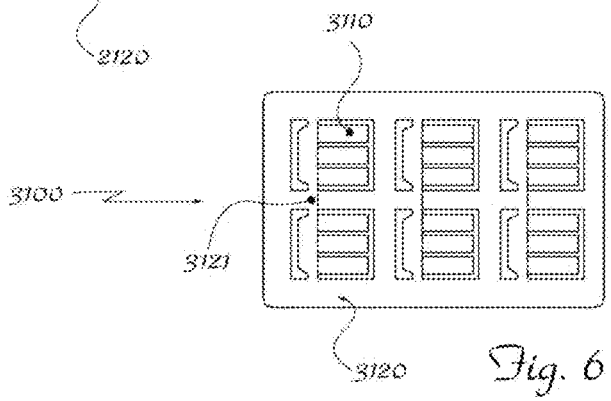
Fig. 6
Fig. 4
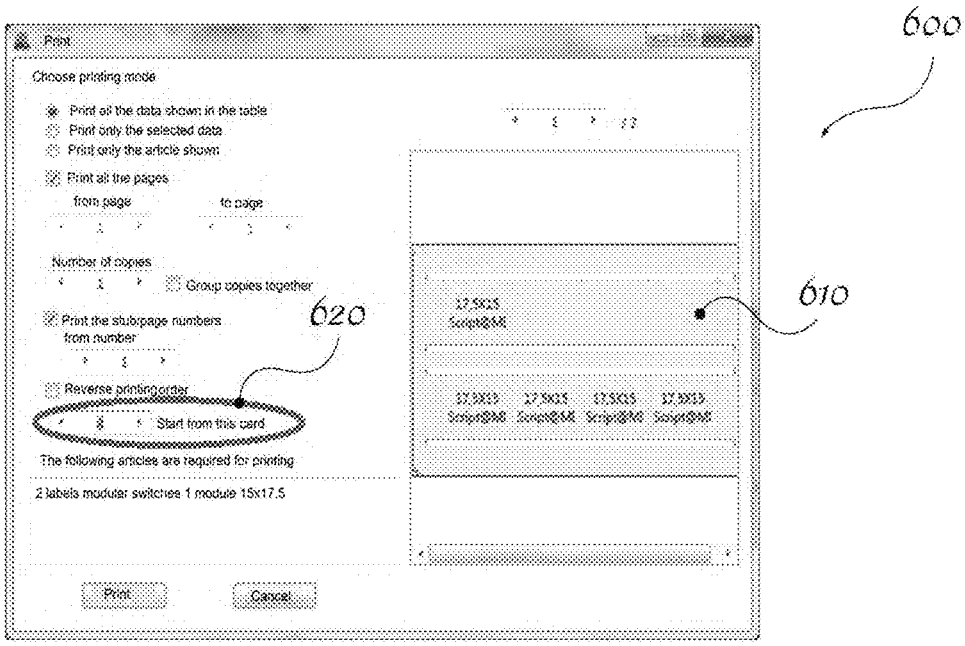

METHOD FOR PRINTING ELECTRICAL-COMPONENT IDENTIFICATION LABELS OBTAINED FROM WHOLE BASE SUPPORTS

The present invention relates to a method for producing labels for electrical components such as electric switchboard terminal blocks and/or electric cable wiring from whole standard-size supports.

It is known in the technical sector relating to the construction of switchboards for the wiring of electrical installations to use terminal blocks designed to be mounted on associated mounting rails and to provide access on the front to the means—normally of the screw type—for retaining the electrical wires which form the cabling of the electrical circuit.

It is also known that, owing to the increasingly greater complexity of electric switchboards, it is necessary to apply on each terminal block and/or on each wire a corresponding identification label which must be visible at the front for reading by the user.

For this purpose, suitable labels which can be applied to terminal blocks or electrical wires are known, these being made from base sheets which are made of different materials, but mainly plastic, owing to the fireproof characteristics which these labels must have in view of their specific application which is subject to heat and/or short-circuits and/or the like which could trigger a fire.

The known methods used in this connection comprise essentially two steps:

- a mechanical pressing step by means of which the base support is divided up into several single labels of the desired size;
- a step for applying writing on the single labels which is performed by means of a plotter.

This method has major drawbacks due to the fact that the writing process performed by the plotter is very costly because of the high cost of the plotter itself, which in turn increases greatly the final cost of the electric switchboard and therefore the costs for the end user.

Also known is the printing technique performed by means of special thermal printers which are specifically designed for this purpose and therefore have a greater cost than normal.

In both cases there is also the drawback due to the fact that printing of the labels must be necessarily performed with the aid of a specialized support plate for the specific printer which further complicates the processes for printing the single labels.

Another known method is based on the use of incision techniques using a cutting plotter, punching or cutting iron which create preferential breakage lines on the base support such that it is provided ready for separation of the single labels by the end user.

Examples of this prior art are described in ZA 200 207 284, US 2014/068983 and WO 2015/151042. ZA 200 207 284 in particular states that:

"The plate consisting of various comb units will usually consist of three consecutive elements and two elements placed abreast, but the number of consecutive and side-by-side positioned elements may also be varied". It is therefore necessary to print all the labels on the same plate during a single printing step and it is therefore not possible to carry out the further successive, separate, printing of a single element, resulting in a large amount of waste and/or the need to accumulate labels which have already been printed and not used.

The technical problem which is therefore posed is that of devising a method and a system for producing labels in particular, but not exclusively, for electrical components such as electric switchboard terminal blocks and/or electric cable wiring, which allows the production of single labels from a predefined base support with the possibility of performing printing using low-cost thermal printing equipment which is substantially widely available.

In connection with this problem it is also desirable that the method should allow the printing also of only some of the labels on the base support and that the latter should be able to be used again several times in the printing apparatus, even though no longer complete, without the need for a special base plate, so as to be able to print only the labels which are needed by the user for the specific needs at the current time.

These results are obtained according to the present invention by a system according to Claim 1 and by a method according to the characteristic features of Claim 7.

With the system according to Claim 1 it is possible to perform printing of a removable region of a base support having some regions which have already been removed; it is possible in fact to convey the base support to a printing area even if it has one or more regions already removed, check the correct positioning thereof in the printing area and selectively print only the regions which have not yet been removed, said regions being selected via control means. The base support will then be conveyed to the outlet for extraction; during its travel path inside the printer the support is moved by transportation rollers and follows a planar path without the risk of getting jammed or being damaged.

Further details may be obtained from the following description of non-limiting examples of embodiment of the subject of the present invention, provided with reference to the accompanying drawings, in which:

FIG. 1: shows a first example of a base support according to a predefined standard, with label regions which can be separated by means of preferential pre-scored cutting lines;

FIG. 2*a*: shows a schematic top plan view of the internal structure of an example of a printer for printing supports according to the predefined standard, forming part of a system according to the invention;

FIG. 2*b*: shows a side view of the internal structure of the printer according to FIG. 2*a;*

FIG. 3: shows a top plan view of a base support similar to that shown in FIG. 1, without a number of removable regions which have already been printed and separated during a previous step;

FIG. 4: shows a schematic view of a control interface of a printer forming part of a system according to the invention;

FIG. 5: shows a second example of embodiment of a base support according to the invention which complies with the predefined standard; and FIG. 6: shows a third example of embodiment of a base support according to the invention complying with the predefined standard.

As shown in FIG. 1 and assuming solely for easier illustration and without a limiting meaning a set of three reference axes respectively in a longitudinal direction X-X, corresponding to the larger dimension of the base support, transverse direction Y-Y, corresponding to the smaller dimension of the base support, and vertical direction Z-Z, corresponding to the thickness of the base support and the finished label, as well as a front side corresponding to the printing surface of the label, a first example of a flat base support 100 is provided in accordance with CARD STANDARD ISO CR80 ISO 7810 and comprises at least one non-removable region 120 and at least one removable region 110 which has dimensions substantially corresponding to the size of a printed label 10 to be provided for the labelling of electrical components such as switchboard terminal blocks and/or wires.

As shown, in the first example of embodiment and based on the directional layout shown in the figures, the non-removable region 120 of the base support comprises a first strip 121*a* and a continuous second strip 121*b* parallel to the longitudinal direction X-X; preferably these longitudinal strips coincide with a respective first longitudinal edge 121*a* and second longitudinal edge 121*b*, opposite to the first edge, of the base support.

In the example shown in FIG. 1, the non-removable region also comprises a first, continuous, transverse strip 122*a* and preferably a second transverse strip 122*b*. Preferably these transverse strips coincide with a respective first, perimetral, transverse edge 122*a* of the support 100 and a second transverse edge 122*b* opposite to the first edge. The four continuous strips define in this way a non-removable, continuous, perimetral region 120 of the base support 100.

The support shown comprises a plurality of regions 110 with dimensions substantially corresponding to the size of the final label 10 to be formed. In the embodiment shown in FIG. 1 the regions 110 are arranged along parallel longitudinal rows situated between said non-removable, longitudinal, perimetral edges 121*a,b*. The removable regions 110 are defined by pre-breakage lines 111 situated parallel to the transverse direction Y-Y.

Rows, or generally removable regions 110, adjacent in the transverse direction are also separated by means of longitudinal pre-breakage lines 112*b* for easy separation of the single printed labels.

The pre-breakage lines 111,112*b* may be formed for example by means of pre-cuts or scoring provided by means of conventional techniques which are not described in detail.

FIG. 2*a* shows a schematic view, from above, of the inside of an example of a printer 500 preconfigured to carry out the printing of base supports according to the standard ISO CR80 ISO 7810 and forming part of a system for producing printed labels for identification of electrical components according to the invention.

The printer 500 has a side 501 for inserting a base support 100 to be printed and an outlet side 502 for extraction of the support, at the opposite end to the inlet side 501 in the longitudinal direction X-X. A printing area 503 is also provided where there is at least one print head which is operated by suitable operating means (conventional per se and not shown in detail) and which is designed to perform printing of the base support 100, via control means for controlling operation of the operating means and the print heads.

The printer further comprises a plurality of transportation rollers 510 for conveying the base support during its longitudinal movement inside the printer, between the inlet side 501 and the outlet side 502, and through the printing area 503.

As shown, the rollers 510 may comprise bottom rollers 511, for example driven by respective driving means operating transverse support pins of the rollers, said bottom rollers being designed to operate on at least the longitudinal edges 121*a*,121*b* of said non-removable region 120 of the base support, and top rollers 512 which may instead provide a simple opposing action. Generally the opposition rollers 512 extend only partially with respect to the transverse width of the support and are at least partially aligned in the longitudinal direction so as to define in any case at least one "strip" (region) for gripping the support 100, extending parallel to the longitudinal direction X-X, preferably comprising the path of a longitudinal edge strip or a non-removable central strip of the base support.

According to the invention it is also envisaged that the printer is preferably associated with a drawer (not shown) for supplying the base supports, inside which a plurality of supports may be arranged so as to be individually removable by said transportation rollers.

Although it is possible to provide a front exit opening (on the inlet side 501) for the printed supports without already removed regions, preferably the support follows a substantially planar path 520 inside the printer between the inlet side 501 and the outlet side 502, the transit plane being substantially tangential to the transportation rollers 510 and coplanar with the printing area 503.

The printer further comprises sensor means S for detecting the presence/position of the support inside the printer, arranged in a position such as to detect one of said edge strips of the perimetral region 120 of the base support 100 when the same is correctly positioned inside the printer. The sensor means S are preferably positioned in at least one end side zone in the transverse direction of the printing area 503. The sensor means are designed to communicate the presence and/or the correct positioning of the support inside the printer to the control means which, in turn, will start the printing operations only if the positioning is correct.

The non-removable perimetral region 120 of the base support ensures that the sensor means are always able to detect correctly the presence and/or position of the support inside the printer, also in the case of printing of supports 100 with removable regions which have already been previously removed. In addition the non-removable edge region 120 ensures that the transportation rollers 510 have a certain grip on the support, ensuring transportation of the base support also in the case of renewed printing of a support which has a number of already removed regions 110.

The system for producing labels further comprises the said control means which may comprise an application which is executed on a multimedia device (for example a PC) which communicates with the printer by means of suitable control drivers. According to a preferred embodiment at least one virtual model of the structure of the base support 100, for example identifying position and size of the removable regions 110, is loaded onto the multimedia device, and/or the control means are able to perform the selective printing on at least one of said removable regions 110 by means of the print heads (or alternative printing means) of the printer.

The selective control of the printer may be performed for example by means of a user interface 600 (FIG. 4) of the application. The application loads a model 610 of the base support 100, for example from a memory of the multimedia device, and comprises, on its interface 600, a selective printing control function 620 able to control selective printing on a base support corresponding to the model loaded; in the example shown it is possible to select the removable region 110 from where sequential printing on the removable regions 110 of the support is to start and/or the number of consecutive removable regions on which printing is to be performed. Other ways of providing selective printing control may be envisaged, such as a user interface which allows selection, from the reproduction 610 of the printing model, of the removable regions 110 to be selectively printed. With the system structure described above, an example of a method according to the present invention for producing labels for the labelling of electrical components from a base support according to a predefined standard, such as the standard ISO CARD CR80 ISO 7810, comprises essentially the following steps:

a) providing a base support 100 according to the CARD STANDARD ISO CR80 ISO 7810 comprising at least one non-removable region 120 and at least one removable region 110 with dimensions substantially corresponding to the size of a label to be printed;

b) providing the printer 500 configured to carry out printing on base supports according to the standard indicated in step a) and associated with means 600 for controlling printing;

c) loading, by means of the control and operating means, the virtual model corresponding to the base support 100 provided;

d) selecting, via the control means 600, at least one removable region 110 to be selectively printed, for example by selecting from the interface 620 the first removable region 110 to be printed and/or the number and/or the position and/or the sequence of successive regions 110 to be printed;

e) inserting the base support 100 provided into the printer on the inlet side 501;

f) conveying the base support 100 by means of the transportation means 510 into the printing area 503;

g) operating, by means of the control and operating means, the printing means so as to perform selective printing, by means of the printer, of alphanumeric and/or graphical data on said at least one removable region 110 selected;

h) conveying the printed support to the outlet side 502 by means of the transportation rollers 510 and extracting the printed base support from the printer.

Once the alphanumeric or graphical data has been printed on one or more removable regions 110 selected it is possible, if required, to separate manually these regions by means of the pre-breakage lines 111, thus obtaining one or more corresponding finished labels.

Preferably, during the selective printing step, the removable regions 110 belonging to a same continuous longitudinal row are not printed, thus leaving intact a continuous longitudinal strip of the base support. Preferably this continuous strip which is not printed is arranged along the transverse extension of the base support in a position such as to determine at least partial gripping by all the transportation rollers of the printer. Although the opposing action of the top rollers 512 does not require the presence of a continuous region in the gripping strip which has not been removed, with this configuration the transportation rollers 510 will always manage to obtain an optimum grip on the base support, even in the case where the latter has regions which have already been removed.

FIG. 3 shows a base support 1100, similar to that shown in FIG. 1, obtained following a first printing operation in the printer and the subsequent removal of the printed removable regions for formation of corresponding labels. The support 1100 has a plurality of already removed removable regions 110 forming part of a same longitudinal row to which a plurality of removable regions 110*a* still attached to the base support also belong; the region 110*a* adjacent to the already removed regions 1110 has a free transverse edge 111 which is no longer connected to the body of the base support 1100. The removable region 110*b* in the front-end position along the row is instead connected to the respective transverse perimetral edge 122.

If, at a later time, it is required to print and/or produce further labels from a support 1100 which has a number of regions 1110 already removed, in addition to removable regions 110 which are yet to be printed, a preferred method of the invention envisages the following further steps:

inserting into the printer the base support 1100 without at least one removable region which has already been printed and separated, for a second or successive printing operation; preferably, during this step, the base support with regions which have already been removed is inserted via a side without removed regions and/or oriented in such a way that, when inserted into the printer, removable regions 110*a* which have not been removed, longitudinally adjacent to regions 1110 already removed, are in a front position (i.e. directed towards the printer) relative to said already removed regions 1000.

c) loading, via the control means, the virtual model corresponding to the base support 100 provided;

d) selecting, via the control means 600, at least one removable region 110 not yet removed and to be selectively printed, for example by selecting from the interface 620 the first removable region 110 to be printed and the number and/or the sequence of successive regions 110 to be printed;

controlling the printer, via the control means, so as to perform selective printing of alphanumeric and graphical labelling data on said at least one removable region 110, not previously removed, of said base support 1100, selected for printing;

extracting the support from the printer and if necessary removing the at least one printed removable region.

The base support 1110 with already removed regions 1110, during the second or subsequent printing operation, follows a substantially planar transit path between the point of insertion into and the point of extraction from the printer. In this way the removable regions 110*a* which have not yet been removed and which are longitudinally adjacent to regions 1110 which have already been removed and therefore have a free end 111*a* which could get stuck in the printer, stopping the printing operations, are prevented from jamming or creating problems during guided transportation by the transportation rollers 510.

FIG. 5 shows a second embodiment of a base support according to the invention with longitudinal rows of removable regions 2110 similar to those of the support 100 shown in FIG. 1 and a non-removable perimetral region 2120. The base support 2100 comprises a continuous, longitudinal, non-removable region 2121 in a transverse position situated in the region where the transportation rollers 510 are at least partially transversely superimposed, in particular in a position substantially central with respect to the transverse extension of the support 2100. With this configuration, an optimum grip of the rollers 510 on the base support is always ensured, irrespective as to which removable regions 2110 are printed and then separated as finished labels in the different printing sequences.

FIG. 6 shows a third embodiment of a base support according to the invention, with a non-removable region which comprises a perimetral region 3120 and a continuous, longitudinal, central, non-removable strip 3121 designed to be engaged by the transportation rollers for optimum feeding of the base support through the printer.

The support 3100 is further characterized by a particular arrangement of the removable regions 3110 for use on a label-holder for electrical cables.

The base support is realized in accordance with the CARD STANDARD ISO CR80 ISO 7810 with the following transverse and longitudinal measurements 58.9×85.60 mm and thicknesses of between 0.25 and 1.25 mm. It is thus also possible to use discontinuous printers with a drawer for loading multiple supports which can be individually removed on separate occasions and which are particularly advantageous for use in the system according to the invention.

According to preferred embodiments the base support is made of material chosen from PVC, PVC Compact, PET-F, PET-G or ABS, which may be easily produced and are particularly suitable for formation of the removable regions.

The base support may comprise adhesive means applied to the bottom side opposite to the printing side.

It is therefore clear how with the method and the system according to the invention it is possible to obtain the selective printing of identification labels for electrical components by means of thermal printers and without using special base plates or continuous printing processes on multiple supports joined together, also in the case of printing of labels attached to a base support which is reintroduced into the printer with empty zones resulting from the previous removal of labels which have already been printed during a previous printing cycle.

Although described in connection with a number of embodiments and a number of preferred examples of embodiment of the invention, it is understood that the scope of protection of the present patent is determined solely by the claims below.

The invention claimed is:

1. A method for obtaining one or more labels from a base support, the method comprising the steps of:

a) providing a flat base support in accordance with CARD STANDARD ISO CR80 ISO 7810, with the following transverse and longitudinal measurements 58.9 mm×85.6 mm and thicknesses ranging between 0.25 and 1.25 mm, the flat base support comprising at least one non-removable region and at least one removable region having dimensions substantially corresponding to the size of the label to be printed, the non-removable region of the flat base support comprising at least one continuous perimetral region (120) comprising a continuous strip (121*a*;121*b*) parallel to the longitudinal dimension (X-X) of the support along each longitudinal edge of the flat base support, and a continuous strip (122*a*;122*b*) parallel to the transverse dimension (Y-Y) along each transverse edge of the base support;

b) inserting the flat base support (100) into a printer for performing printing on base supports according to the standard indicated in step a) via an inlet side (501), the printer having transportation rollers (510) for conveying the base support along a transit path between the inlet side (501), a printing area (503) and an outlet/extraction side (502), and sensor means for detecting the presence/position of the flat base support inside the printer, the sensor means being arranged in a position such as to detect one of said edge strips of the continuous perimetral region (120) of the flat base support, when the latter is correctly positioned inside the printer;

conveying of the flat base support by means of the transportation rollers (510) to the printing area (503) and checking as to the presence and correct positioning of the flat base support in the printing area (503) via the sensor means, the transportation rollers (510) being arranged so as to define at least one region for gripping the base support, extending parallel to the longitudinal direction (X-X), and so as to operate along at least one of said longitudinal edge strips (121*a*;121*b*) of the flat base support, when the latter is correctly positioned along the transit path;

c) selectively printing alphanumeric and/or graphical labelling information on at least one selected removable region of the base support, by means of the printer controlled by control means adapted to control selective printing by the printer on one or more of said removable regions of the flat base support; and d) conveying the printed flat base support to the outlet side (502) and extracting the printed flat base support from the printer, wherein the flat base support provided in step a) is without at least one removable region which has already been removed, wherein the base support with the at least one already removed region is inserted from a front side of the flat base support which is intact and/or without removed regions and/or is oriented so that, upon insertion, removable regions (110*a*) which have not been removed and are longitudinally adjacent to one or more already removed regions (1110) are positioned in front of said already removed regions (1110), wherein the printer is controlled so as to print labelling information on at least one removable region of said flat base support, which has not been previously removed, and wherein the base support follows a substantially planar path between the point of insertion into and point of extraction from the printer, the transit plane being substantially tangential to the transportation rollers (510) and coplanar with the printing area (503).

2. The method according to claim 1, further comprising the step of separating the at least one printed removable region from the printed flat base support.

3. The method according to claim 1, characterized in that the flat base support without at least one removable region provided in step a) is a flat base support from which a removable region has already been printed and separated, obtained by:

providing a flat base support in accordance with the CARD STANDARD ISO CR80 ISO 7810, with the following transverse and longitudinal measurements 58.9 mm×85.6 mm and thicknesses ranging between 0.25 and 1.25 mm, and comprising at least one non-removable region and at least one removable region having dimensions substantially corresponding to the size of the label to be printed;

inserting the flat base support (100) into the printer for performing printing on base supports according to the standard indicated, via the inlet side (501), with conveying of the support by means of the transportation rollers (510) to the printing area (503) and checking as to the presence and correct positioning of the base support in the printing area (503) via the sensor means;

selectively printing, by means of the printer controlled by the control means, alphanumeric and/or graphical labelling information on at least one selected removable region of the base support;

conveying the printed base support to the outlet side (502) and extracting the printed base support from the printer, wherein the base support follows a substantially planar path between the point of insertion into and point of extraction from the printer; and extracting the base support from the printer and removing the printed removable region.

4. The method according to claim 1, characterized in that the control means comprises a user application for execution on a processing device comprising a user interface, the selection of at least one removable region of the flat base support to be selectively printed and the selective printing on said at least one selected removable region being performed by means of said user application.

5. The method according to claim 4, wherein a virtual model of the flat base support to be printed is loaded in a memory and retrieved by the control means which are configured to use the virtual model as a guide for selective printing, the user interface comprising at least one command for selecting, with reference to the virtual model, said at least one removable region to be printed.

6. The method according to claim 1, wherein the printer is a thermal type printer.

7. The method according to claim 1, wherein the non-removable region of the flat base support comprises a continuous longitudinal strip extending between two opposite transverse edges of the support and different from the longitudinal perimetral edges of the support, preferably in a central position with respect to the transverse extension of the support.

8. The method according to claim 1, wherein the base support is made of a material selected from the group consisting of PVC, PVC Compact, PET-F, PET-G, and ABS.

* * * * *